US011222557B2

(12) United States Patent
Davies

(10) Patent No.: US 11,222,557 B2
(45) Date of Patent: Jan. 11, 2022

(54) SPINNING INDICATOR FOR PROSPECTIVE PASSENGERS AT TRANSIT STOPS AND METHOD OF USE

(71) Applicant: Fred Owen Davies, St. George, UT (US)

(72) Inventor: Fred Owen Davies, St. George, UT (US)

( * ) Notice: Subject to any disclaimer, the term of this patent is extended or adjusted under 35 U.S.C. 154(b) by 336 days.

(21) Appl. No.: 16/402,461

(22) Filed: May 3, 2019

(65) Prior Publication Data

US 2019/0340961 A1 Nov. 7, 2019

Related U.S. Application Data

(60) Provisional application No. 62/666,664, filed on May 3, 2018.

(51) Int. Cl.

| | |
|---|---|
| ***G09F 13/16*** | (2006.01) |
| ***G09F 7/22*** | (2006.01) |
| *G09F 7/18* | (2006.01) |

(52) U.S. Cl.
CPC ..... *G09F 13/165* (2013.01); *G09F 7/22* (2013.01); *G09F 2007/1804* (2013.01)

(58) Field of Classification Search
CPC ... G09F 13/165; G09F 7/22; G09F 2007/1804
See application file for complete search history.

(56) References Cited

U.S. PATENT DOCUMENTS

| | | | | | |
|---|---|---|---|---|---|
| 2,997,344 | A * | 8/1961 | Whiteman | B60B 7/20 | 301/37.25 |
| 3,219,391 | A * | 11/1965 | Hettinger | B60B 7/20 | 301/37.25 |
| 3,495,347 | A * | 2/1970 | Sims | F16B 5/02 | 40/587 |
| 4,131,079 | A * | 12/1978 | Rousseau, Jr. | G09F 7/22 | 116/22 A |
| 5,036,613 | A * | 8/1991 | Smith | F41A 23/12 | 42/94 |
| 5,190,354 | A * | 3/1993 | Levy | B60B 7/20 | 301/37.25 |
| 2004/0075332 | A1* | 4/2004 | Good | B60B 7/20 | 301/37.35 |
| 2005/0146204 | A1* | 7/2005 | Kim | B60B 7/18 | 301/37.25 |

(Continued)

FOREIGN PATENT DOCUMENTS

| | | | | |
|---|---|---|---|---|
| GB | 2573825 A * | 11/2019 | ..... | E01F 9/65 |

*Primary Examiner* — Gary C Hoge
(74) *Attorney, Agent, or Firm* — Gurr Brande & Spendlove, PLLC; Robert A. Gurr

(57) ABSTRACT

A spinnable indicator for transit stops has a disc having a front side and a rear side, the front side having a reflective portion and a non-reflective portion, and a mounting bracket, wherein the disc is spinnably coupled to the mounting bracket, the mounting bracket mountable to a pole or beam. The reflective portion creates high visibility at night. In one method of use, a prospective passenger approaches a spinnable indicator, and, when a bus or other transit unit is approaching, spins the spinnable indicator. The reflective portion on the front side of the spinnable indicator alerts the driver that a prospective passenger is waiting transit.

5 Claims, 16 Drawing Sheets

(56) References Cited

U.S. PATENT DOCUMENTS

| | | | | |
|---|---|---|---|---|
| 2007/0046096 | A1* | 3/2007 | Marriott | B60B 7/04<br>301/37.25 |
| 2011/0287207 | A1* | 11/2011 | Shwed | G09F 13/165<br>428/53 |
| 2018/0374404 | A1* | 12/2018 | Ainge | G09F 19/16 |

* cited by examiner

SPINNING INDICATOR FOR PROSPECTIVE PASSENGERS AT TRANSIT STOPS AND METHOD OF USE

CROSS-REFERENCE TO RELATED APPLICATIONS

This application claims the benefit of U.S. Provisional Application Ser. No. 62/666,664, filed on May 3, 2018, which is incorporated herein by reference.

TECHNICAL FIELD

The present disclosure relates to prospective passenger visibility at bus and other transit stops. More particularly, the present disclosure relates to a spinnable indicator for use by a prospective passenger awaiting a bus or other transit vehicle.

BACKGROUND

Public transportation is utilized around the world, with buses remaining an ever-present method of transportation. Due to the flexibility of travel, innumerable bus stops are located around the world. Bus stops are typically identified with a marker, such as a pole indicating the stop and perhaps the bus and/or route that stops there. While this pole and the awaiting prospective passengers are easily seen during the day, low light and nighttime conditions make it difficult for a bus driver to 1) identify the stop location; and 2) determine whether prospective passengers are awaiting the bus. While some stops may have streetlights nearby, many do not. Further, even if the streetlight is nearby, it may still be difficult to see whether or not a prospective passenger is waiting. Further, a new driver, or a driver that is new to a route, may have difficulty identifying bus stops even during daylight conditions.

Additionally, it can be challenging for some prospective passengers to identify where the bus stop is located. For example, individuals with impaired vision or that are blind may not be able to distinguish the bus stop pole from other poles on the street, such as speed limit signs, no parking signs, light poles, etc. As a result, a blind individual must often ask for assistance in locating the stop. Even for those individuals without vision impairments, it can be difficult to identify the stop in darkness or other low-light conditions (e.g., fog).

Therefore, there remains a need for a system and method of identifying transit stops for use by both prospective passengers and drivers, and that particularly allows a bus driver to quickly and easily determine when a prospective passenger is waiting. The present disclosure seeks to solve these and other problems.

SUMMARY OF EXAMPLE EMBODIMENTS

In one embodiment, a spinnable indicator for transit stops comprises a disc having a front side and a rear side, and a mounting bracket, wherein the disc is spinnably coupled to the mounting bracket, the mounting bracket mountable to a pole or beam. In one embodiment, at least a portion of the front side of the disc comprises reflective material.

In one embodiment, a spinnable indicator for transit stops comprises a spinning member having a front side, a rear side, and a reflective surface on at least a portion of the front side, one or more bearings, and a mounting bracket.

In one embodiment, a spinnable indicator may further comprise light-emitting diodes (LEDs) or other lights.

In one method of use, a prospective passenger approaches a spinnable indicator, and, when a bus or other transit unit is approaching, spins the spinnable indicator. The reflective surface on the front side of the spinnable indicator alerts the driver that a prospective passenger is waiting transit.

DETAILED DESCRIPTION OF EXAMPLE EMBODIMENTS

Figure 1:
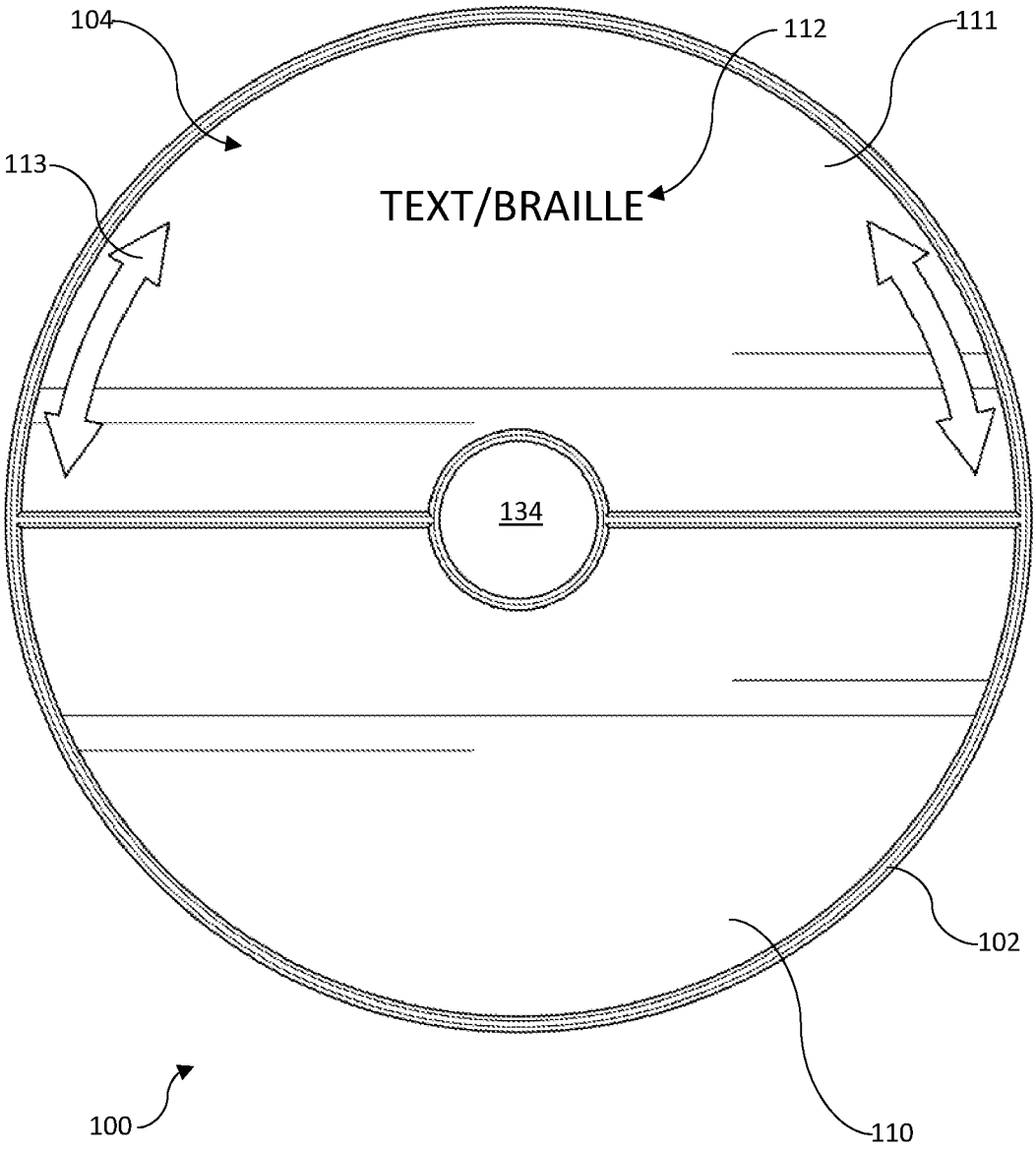
FIG. 1 is a front elevation view of a spinnable indicator.
Figure 2:
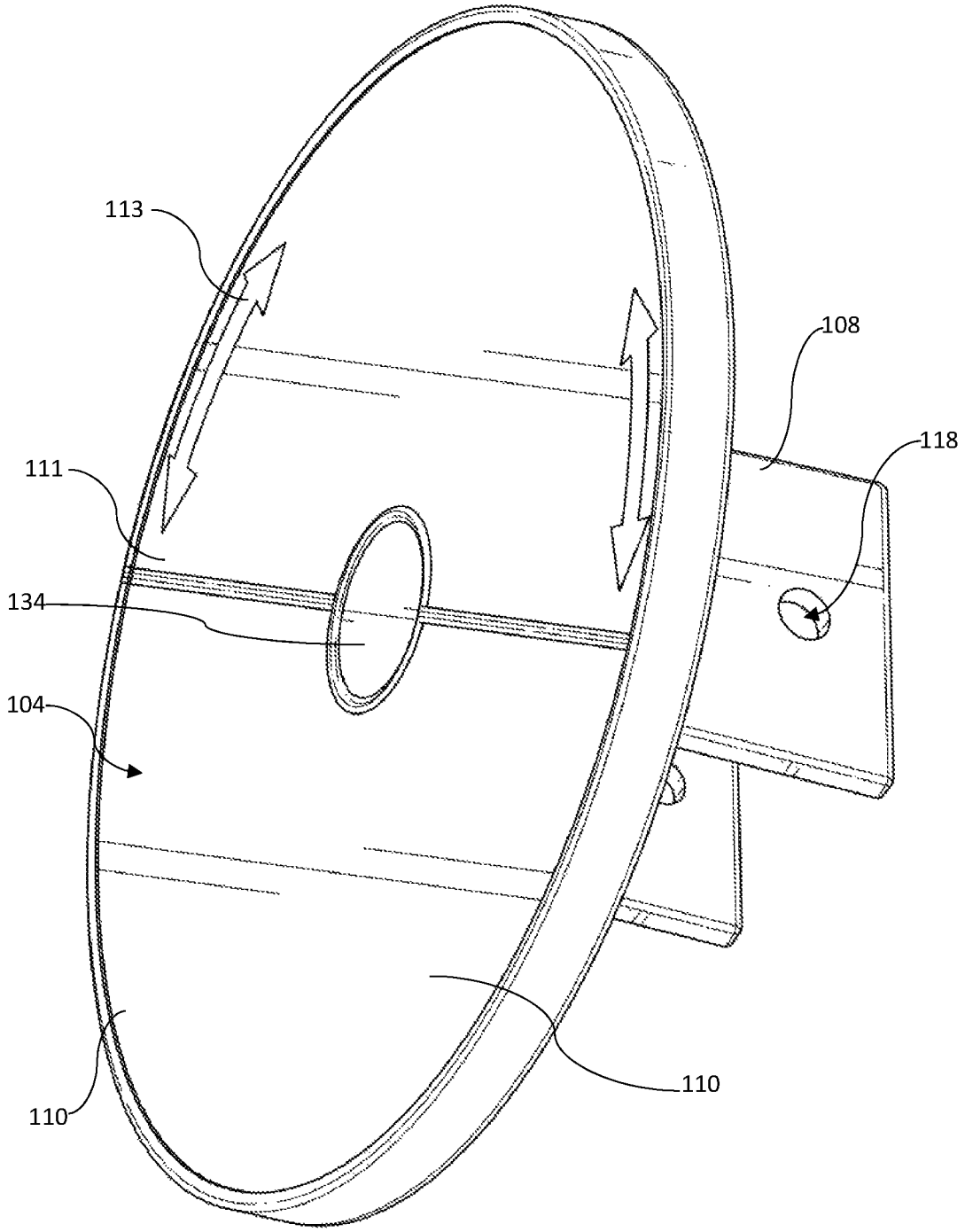
FIG. 2 is a front, side perspective view of a spinnable indicator.
Figure 3:
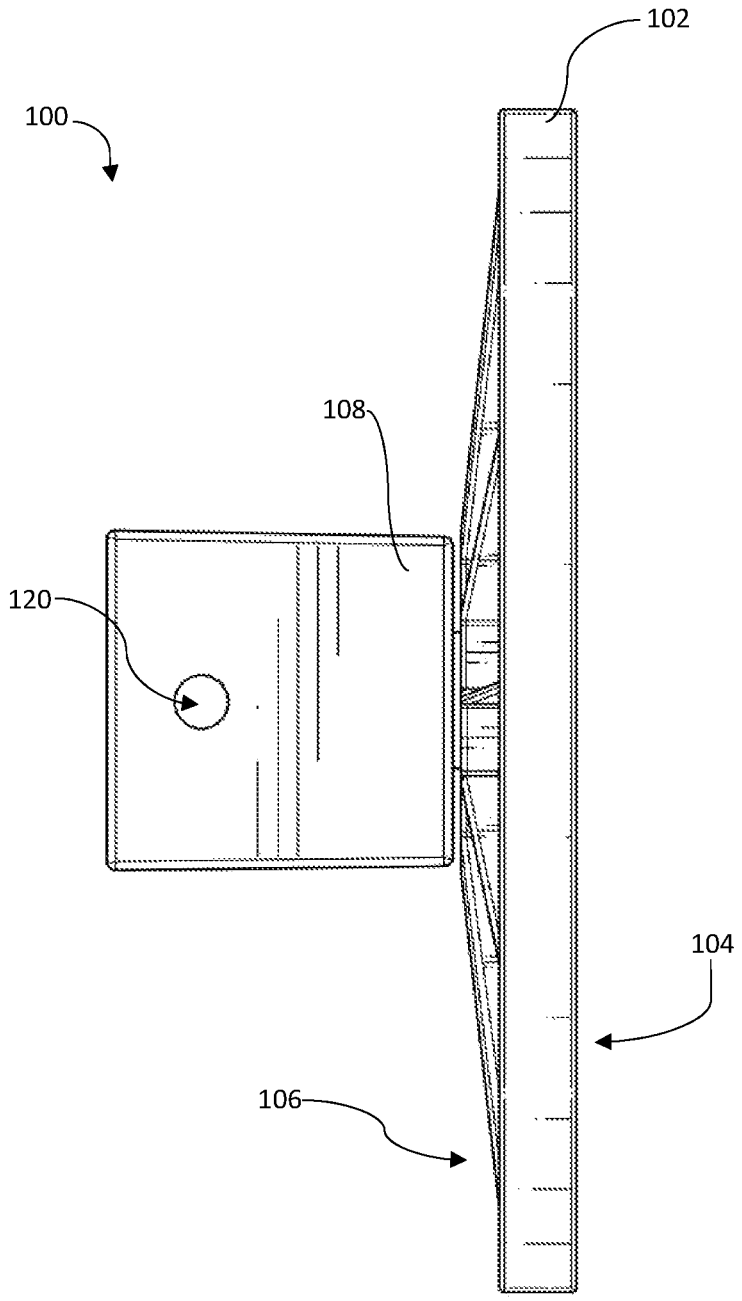
FIG. 3 is a side elevation view of a spinnable indicator, the opposite side being a mirror image.
Figure 4:
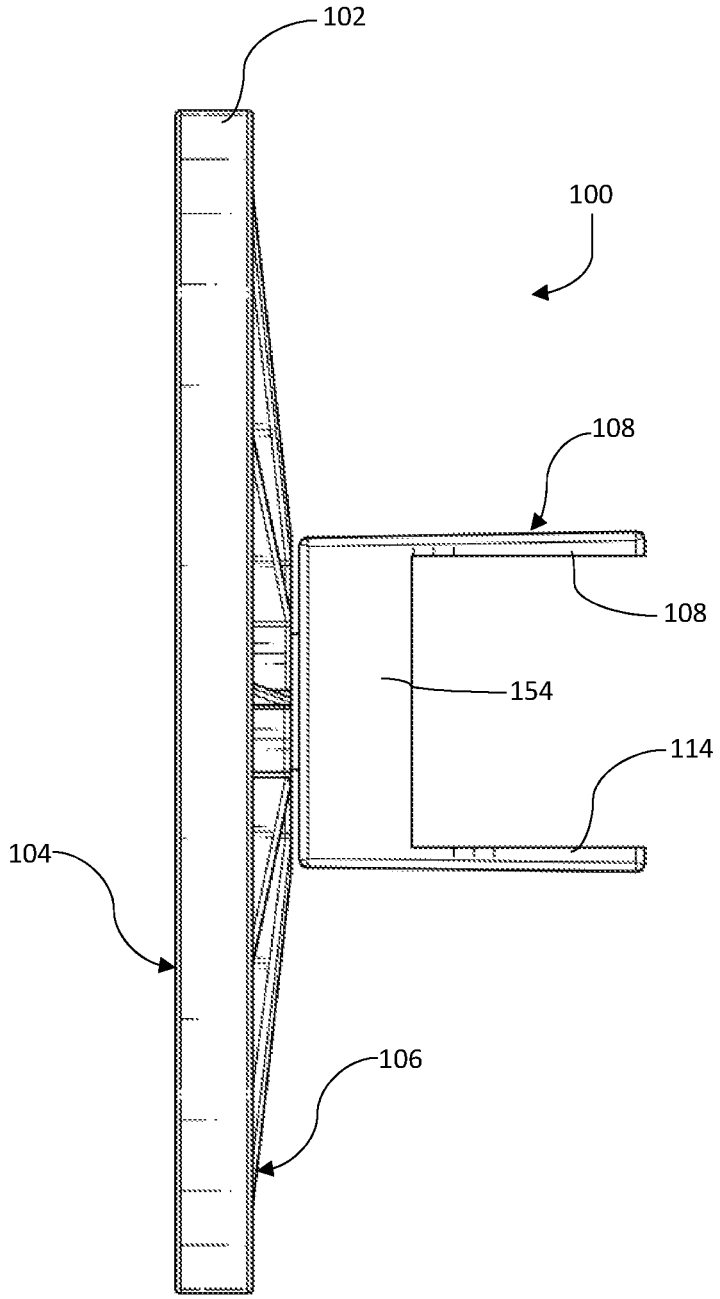
FIG. 4 is a top plan view of a spinnable indicator.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a system and method of identifying transit stops for use by both prospective passengers and drivers, and that particularly allows a bus driver to quickly and easily determine when a prospective passenger is waiting. As will be appreciated from the below disclosure, the spinnable indicator shown and described herein solves these needs and others.

Figure 5:
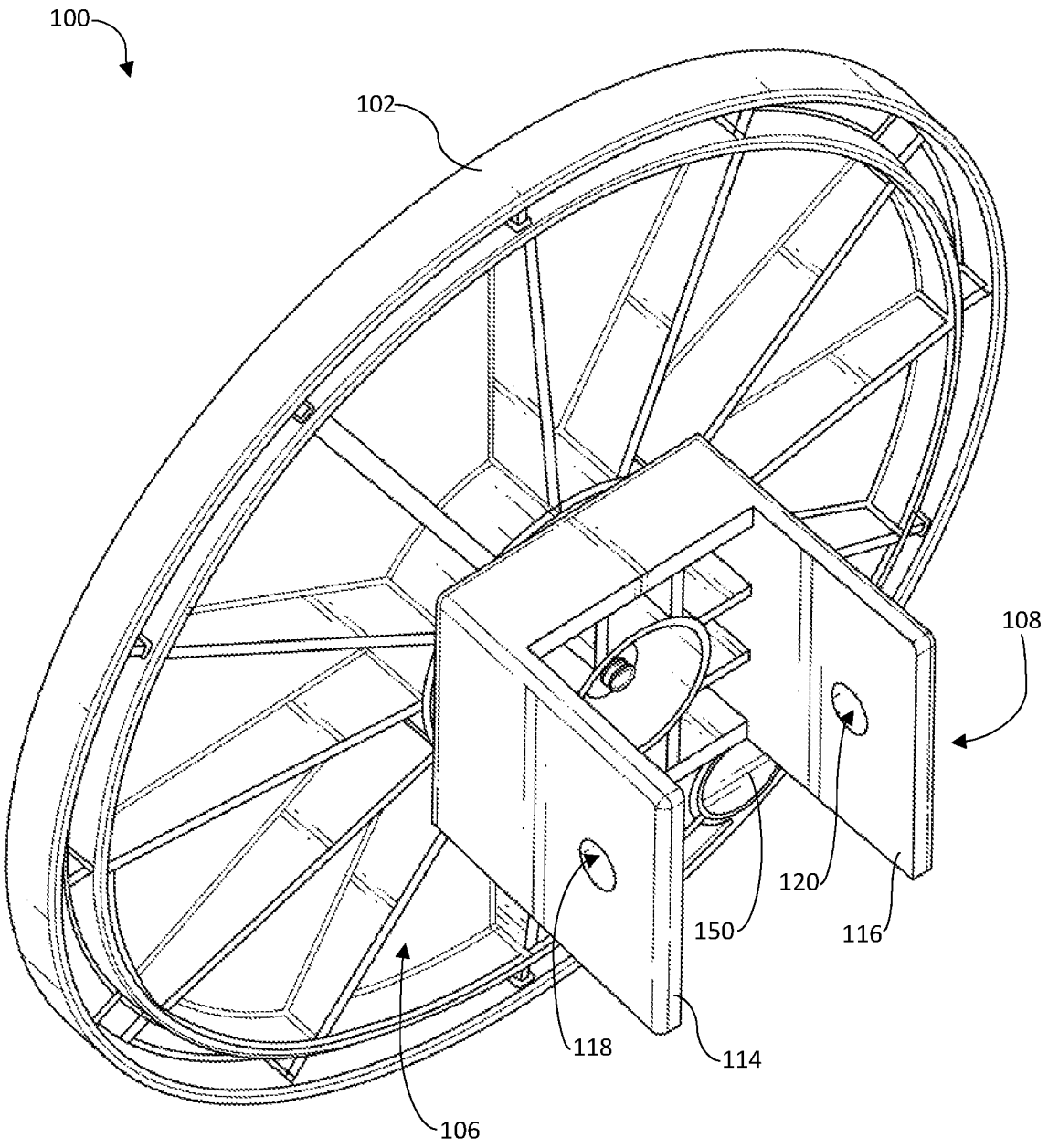
FIG. 5 is a back perspective view of a spinnable indicator.
Figure 16:
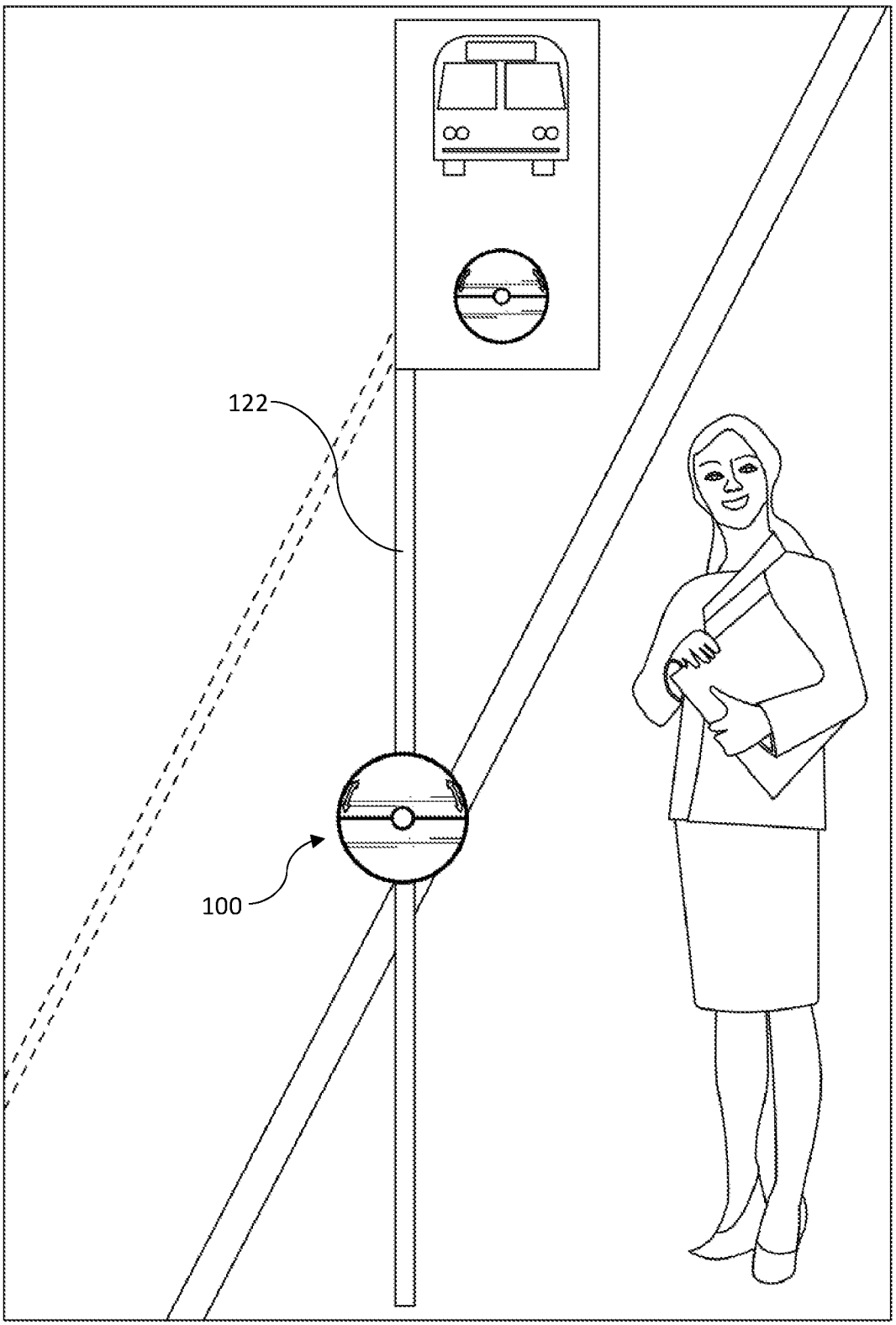
FIG. 16 is a front perspective view of a spinnable indicator in use.

In one embodiment, as shown in FIGS. 1-6, a spinnable indicator 100 for transit stops comprises a disc 102 having a front side 104 and a rear side 106, and a mounting bracket 108. The front side 104 of the disc 102 comprises a reflective portion 110 and a non-reflective portion 111. As shown here, the reflective portion 110 is the lower half of the front side 104, while the non-reflective portion 111 is the upper half of the front side 104. In one embodiment, as shown in FIG. 1, the front side 104 may further comprise text/braille 112 and/or arrows 113 as instructions for use, which are preferably in the non-reflective portion 111. The reflective portion 110 may occupy less than fifty-percent or greater than fifty-percent, but would not be one-hundred percent of the front side 104. The mounting bracket 108 is configured to secure the spinnable indicator 100 to a pole or shaft. For example, as best shown in FIG. 5, the mounting bracket 108 may have a first arm 114 and a second arm 116, the arms spaced so as to receive a pole or beam therebetween, with a bolt, rivet, locking pin, or other securing mechanism passing through securing apertures 118, 120. FIG. 16 illustrates an example of the spinnable indicator 100 secured to a pole 122 using the mounting bracket 108.

Figure 7:
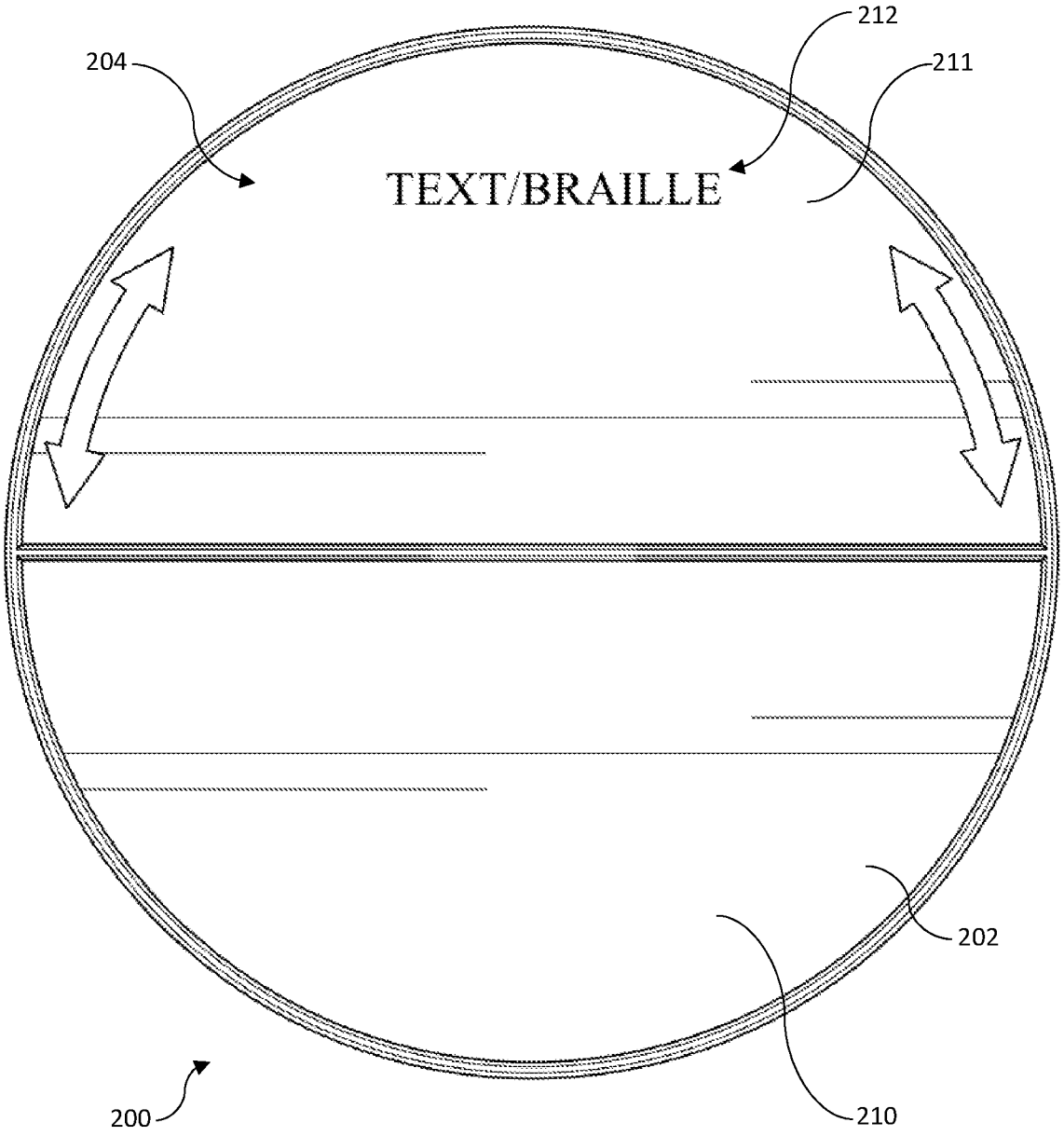
FIG. 7 is a front elevation view of a spinnable indicator.
Figure 8:
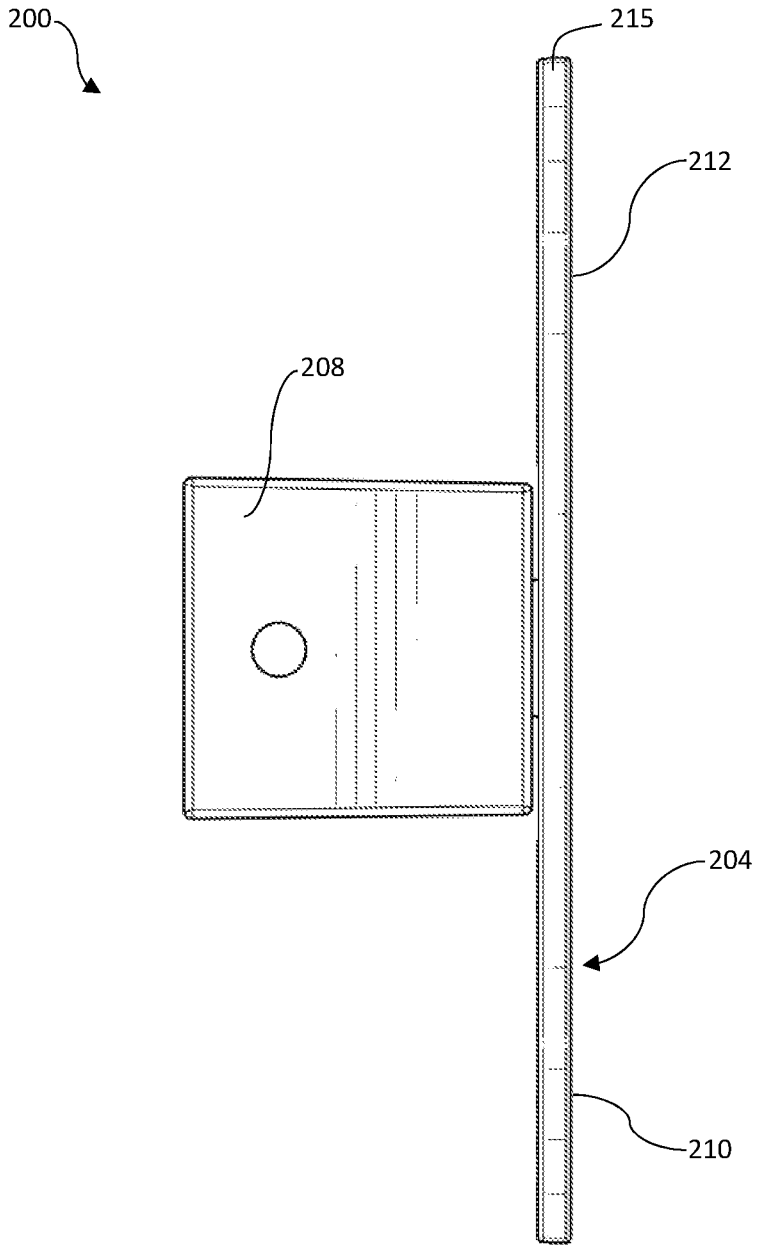
FIG. 8 is a side elevation view of a spinnable indicator.
Figure 9:
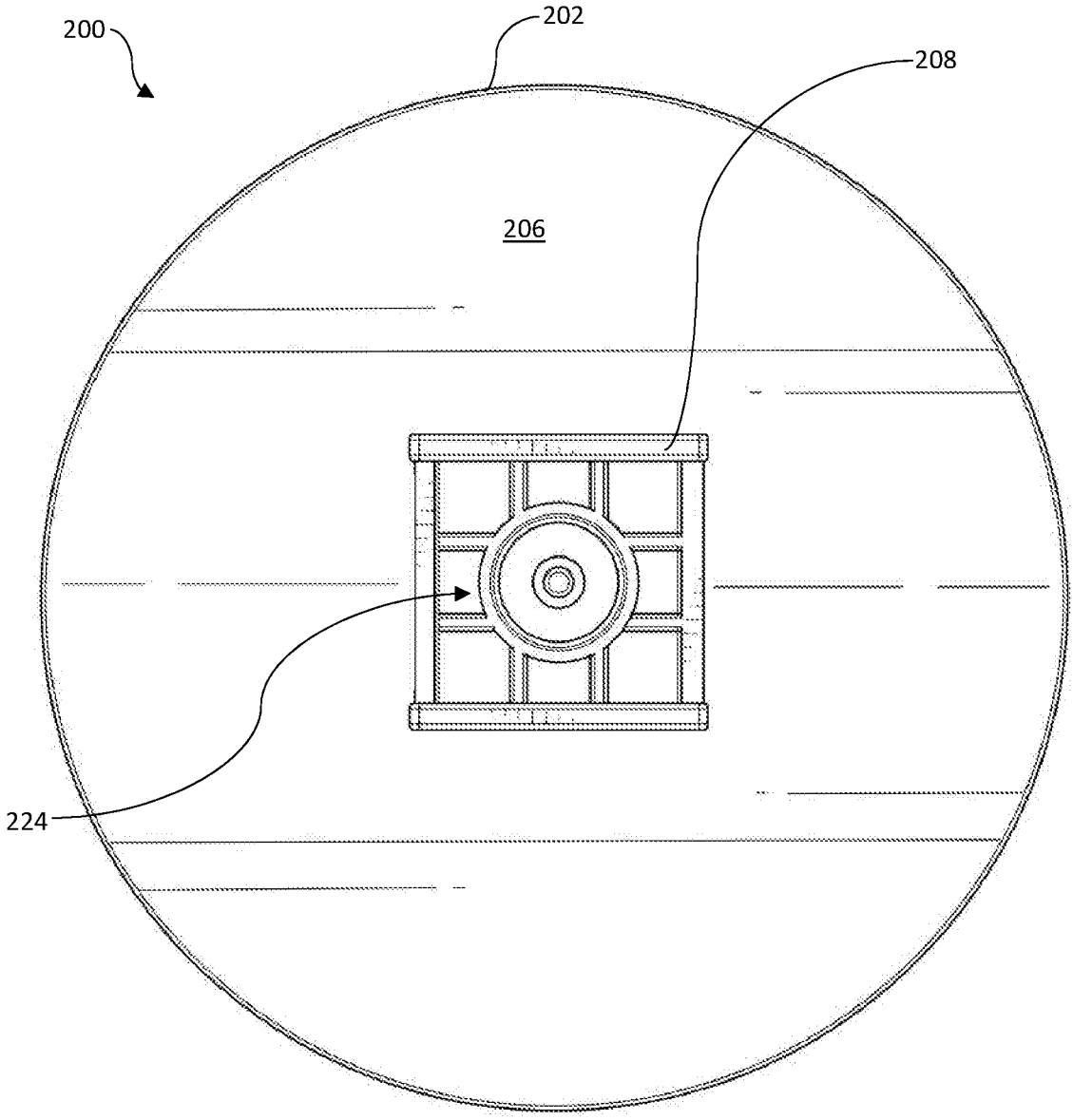
FIG. 9 is back elevation view of a spinnable indicator.

As shown in FIGS. 1-6, the spinnable indicator 100 may be manufactured from plastics and similar materials. However, as shown in FIGS. 7-9, the spinnable indicator 200 may be cut or formed from solid materials, such as aluminum. Accordingly, in one embodiment, the spinnable indicator 200 for transit stops comprises a disc 202 having a front side 204 and a rear side 206, a mounting bracket 208, and a rotating mechanism 224 which may comprise bushings, ball bearings, etc. The front side 204 of the disc 202 comprises a reflective portion 210 and a non-reflective portion 211. In one embodiment, the front side 204 may further comprise instructions 212 for use, which are preferably in the non-reflective portion 211. The edge 215 may be beveled, smoothed, or rubber-coated as well, although not required.

Figure 10:
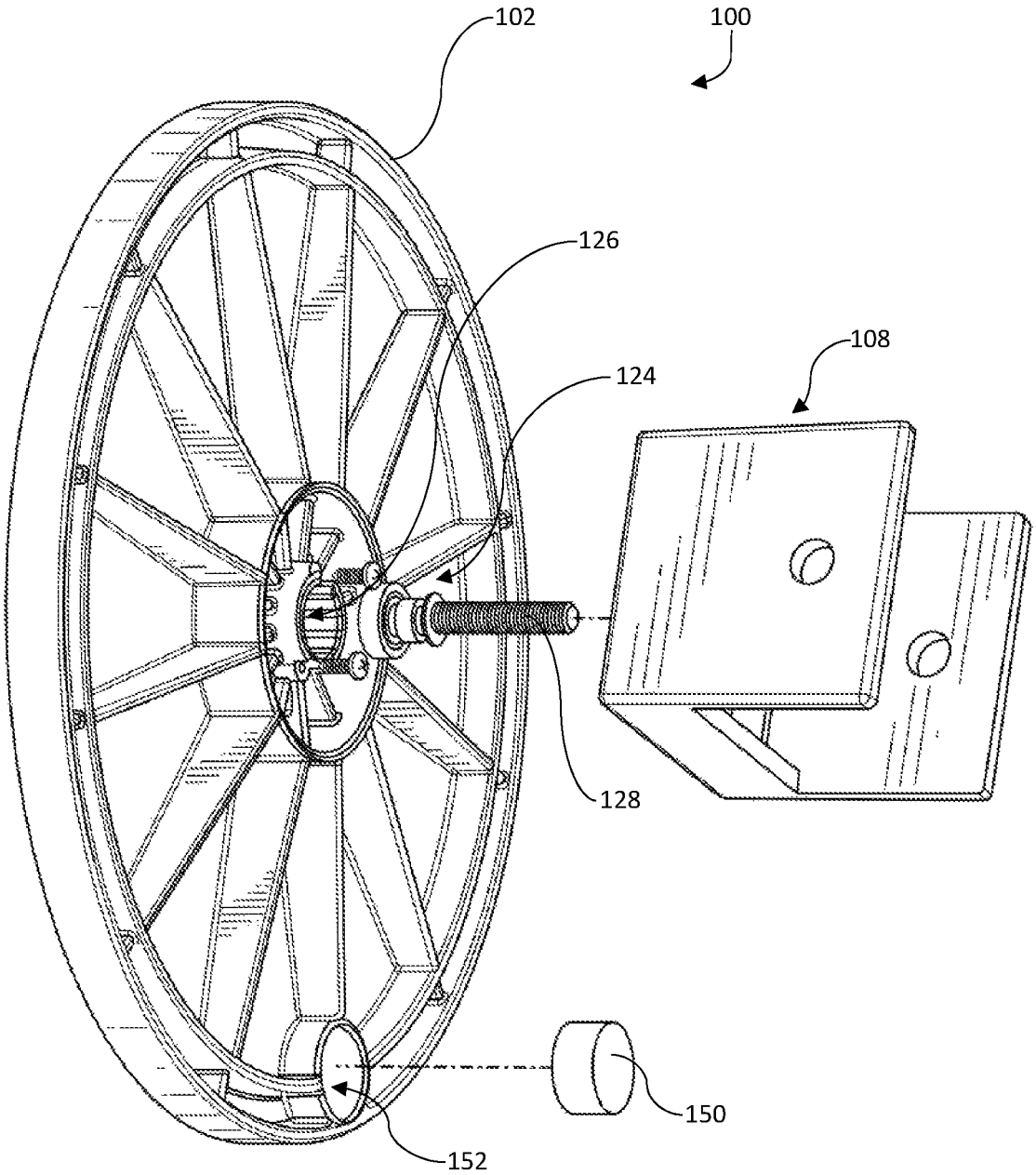
FIG. 10 is a back exploded view of a spinnable indicator.
Figure 14:
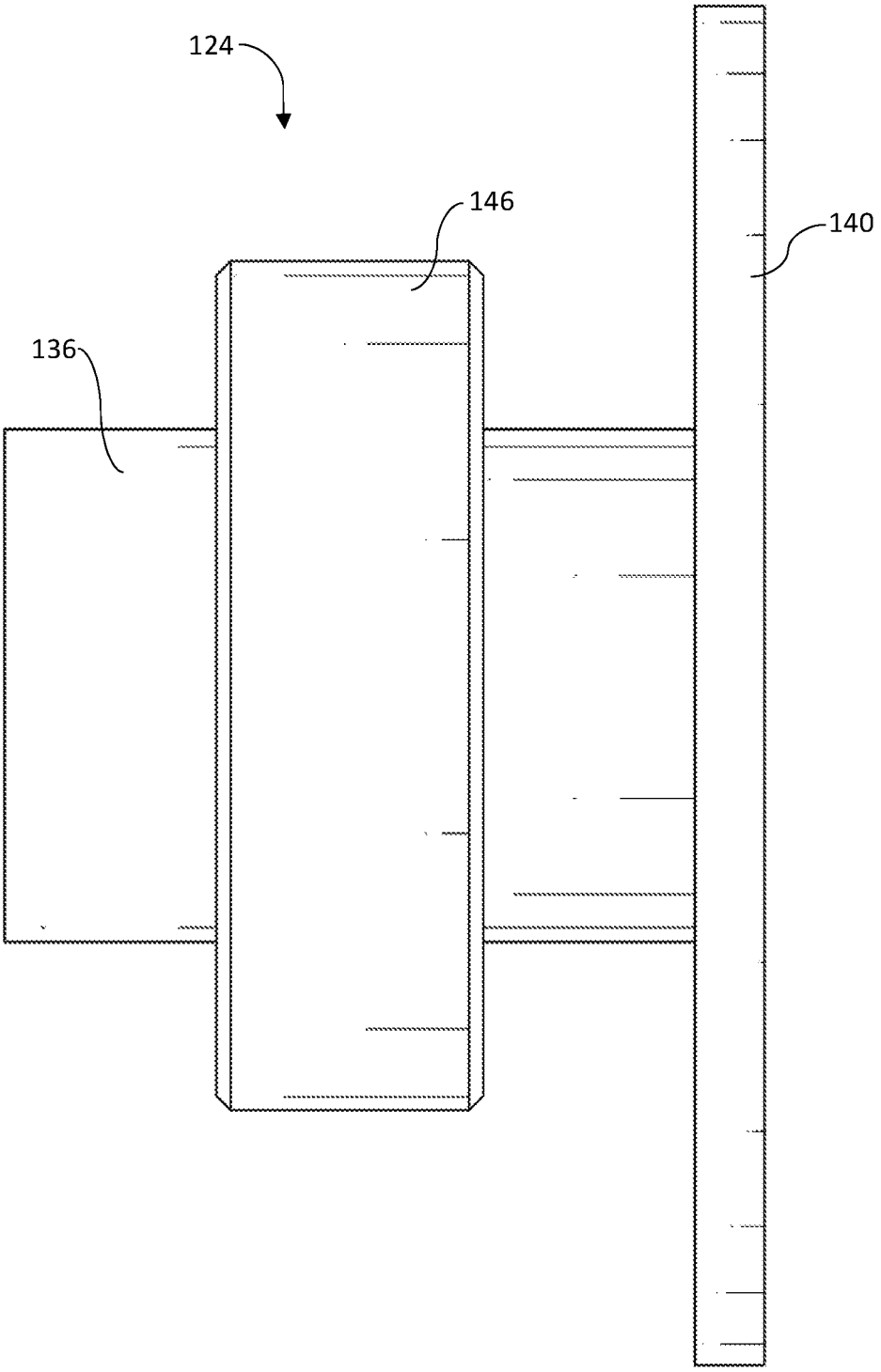
FIG. 14 is a side elevation view of bearing components of a spinnable indicator.
Figure 15:
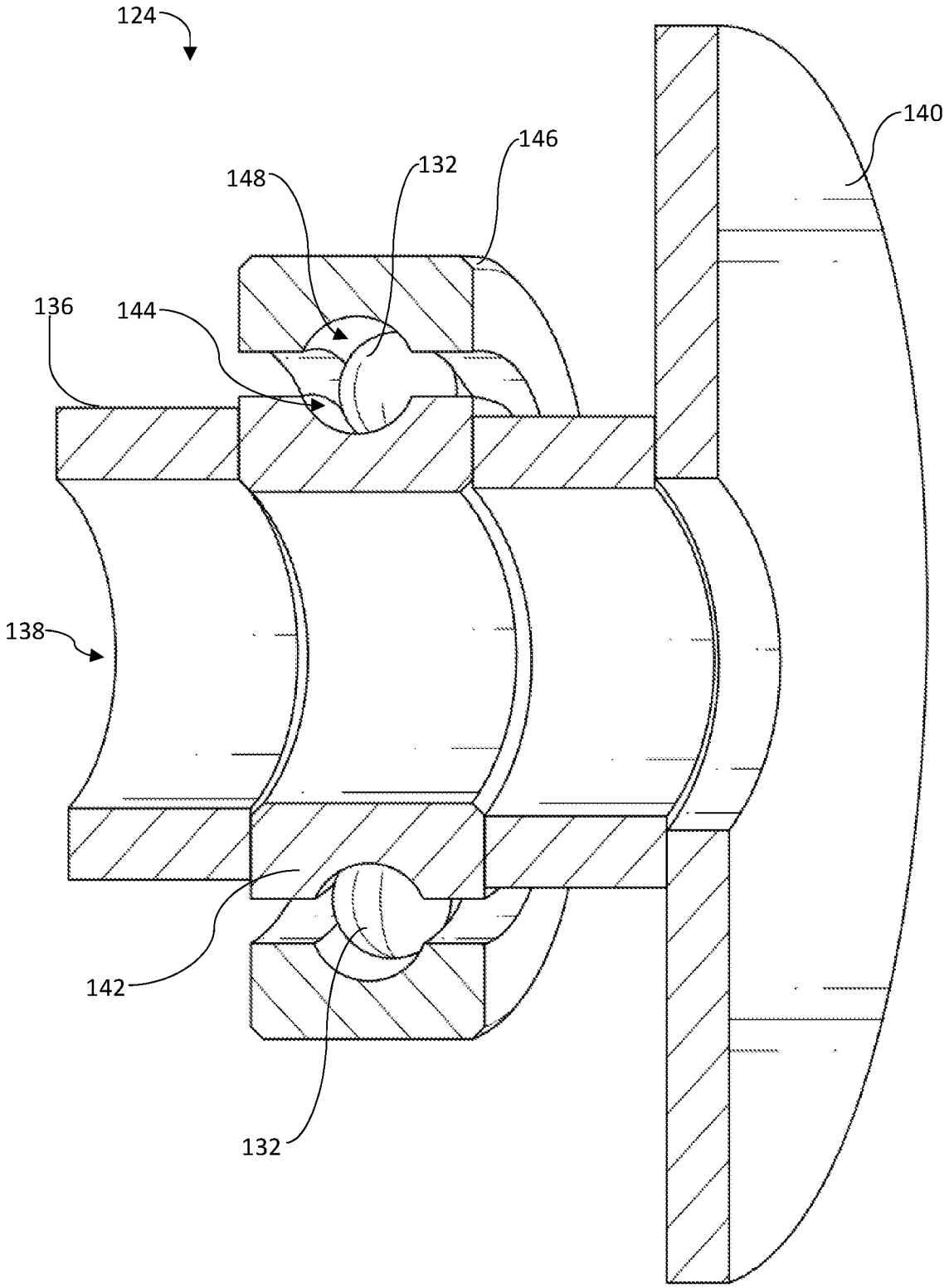
FIG. 15 is a side perspective cross-section of bearing components of a spinnable indicator.

In one embodiment, referring to FIGS. 10-16, the disc 102 is spinnably coupled to the mounting bracket 108 using a rotational mechanism 124 (best seen in FIGS. 14-15). The rotational mechanism 124 is received within aperture 126 in the disc 102. A bolt 128 passes through the front side 104, through the rotational mechanism 124, and through the mounting bracket 108, where it is secured using a nut 130, as best seen in the cross-section of FIG. 8. Referring to FIG. 9, the rotational mechanism 124 is seen within the disc 102, where individual bearings 132 are visible. FIG. 10 illustrates the rotational mechanism 124 with the bolt 128 passing therethrough. A cap 134 is shown thereon, and would be placed on the front side 104 of the disc 102, covering the head of the bolt 128.

FIGS. 14-15 illustrate the rotational mechanism 124 in more detail. In one embodiment, as shown, the inner member 136 comprises a bolt aperture 138 and a front plate 140. A middle portion 142 comprises a bearing groove 144. Outer member 146 comprises bearing groove 148, with bearing grooves 148 and 144 aligning so as to receive ball bearings 132 therebetween. While two grooves are shown, it will be appreciated that only one is required, forming what is known as a "deep groove" bearing in the art. Accordingly, the disc 102 engages the outer member 146, which is spinnable on the inner member 136 due to ball bearings 132, allowing the disc 102 to likewise spin. It will be appreciated that while ball bearings were specifically used as an example herein, the spinnable indicator is not so limited and the rotational mechanism 124 may be of any suitable type, including roller bearings, needle bearings, bushings, or other rotational mechanisms.

As discussed earlier, it will be appreciated that numerous materials may be used to manufacture the spinnable indicator 100, 200. In one embodiment, non-corrosive and weather-resistant materials are preferred, such as plastics, fiberglass, carbon fiber, aluminum, etc. Notwithstanding the foregoing, other materials may be used, including metals, steel, wood, etc.

While described and shown as disc 102, 202, it will be appreciated that a disc shape is not required. A disc shape may be preferred so as to lessen potential injury (e.g., by eliminating corners), but other shapes and formfactors may be used. Accordingly, in one embodiment, a spinnable indicator for transit stops comprises a spinning member (which may be disc 202, but may also be square, hexagonal, octagonal, etc.) having a front side, a rear side, and a reflective surface on at least a portion of the front side, but not the entire surface, a rotational mechanism, and a mounting bracket. In one embodiment, at least half of the front side comprises reflective material. In another embodiment, less than one hundred percent of the front side comprises reflective material. In other words, the spinning member 202 comprises a reflective portion 210 and a non-reflective portion 211. This allows a transit driver to determine whether the spinnable indicator 200 is spinning (due to the flashing or strobe effect created by having both a reflective and non-reflective portion 210, 211 respectively), which indicates the presence of a prospective passenger.

Figure 6:
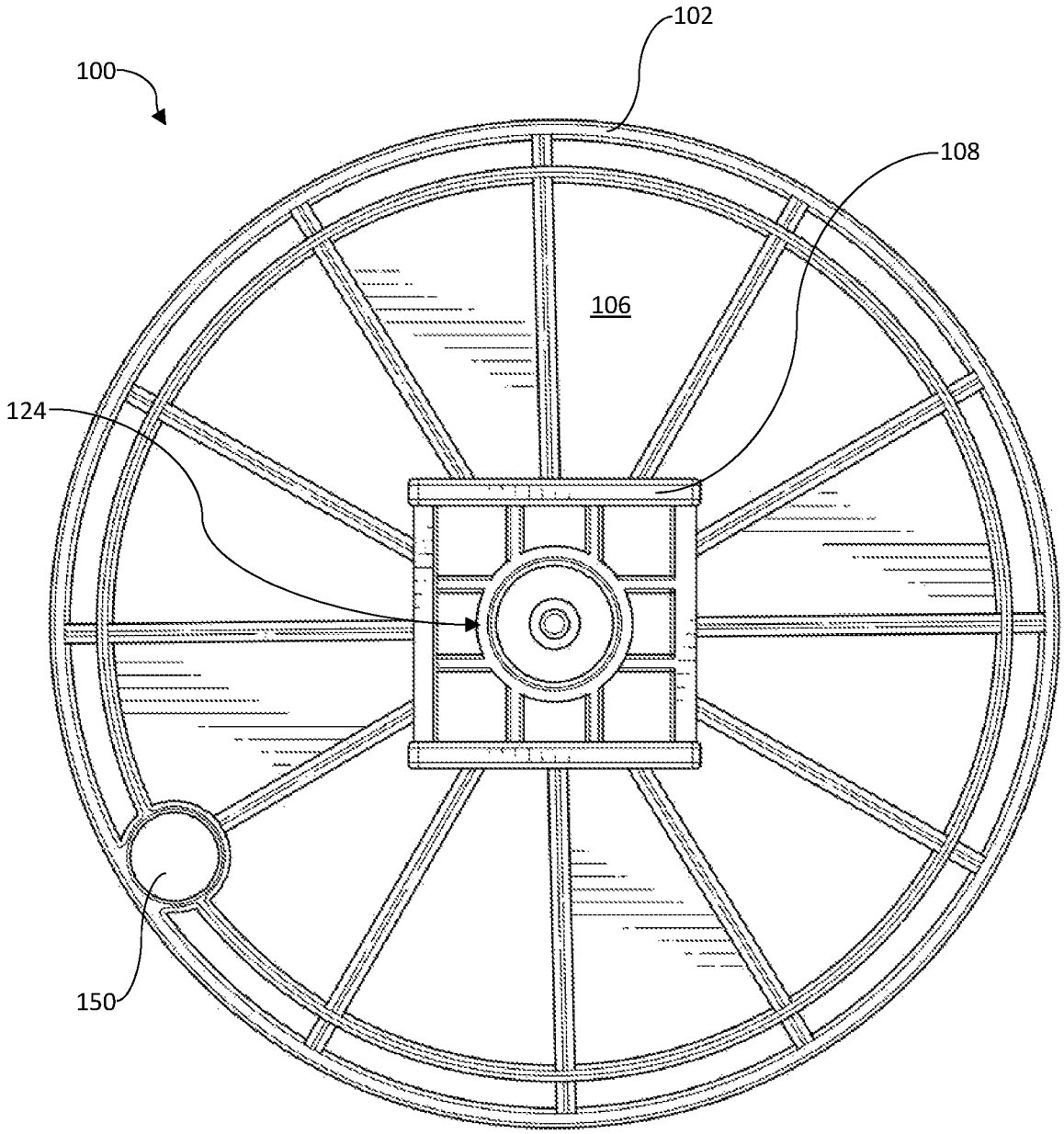
FIG. 6 is a back elevation view of a spinnable indicator.
Figure 11:
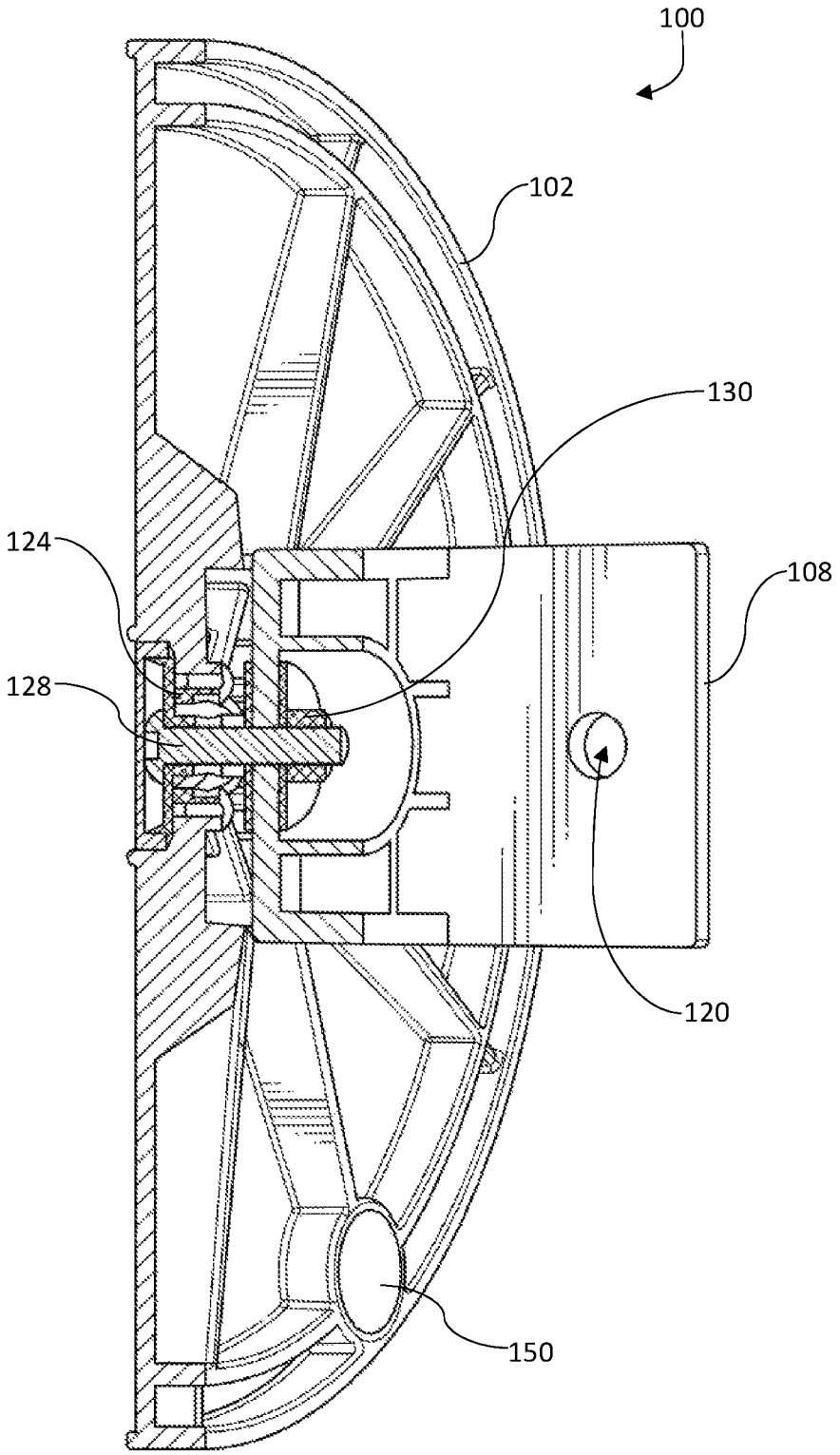
FIG. 11 is a side perspective cross-section of a spinnable indicator.
Figure 12:
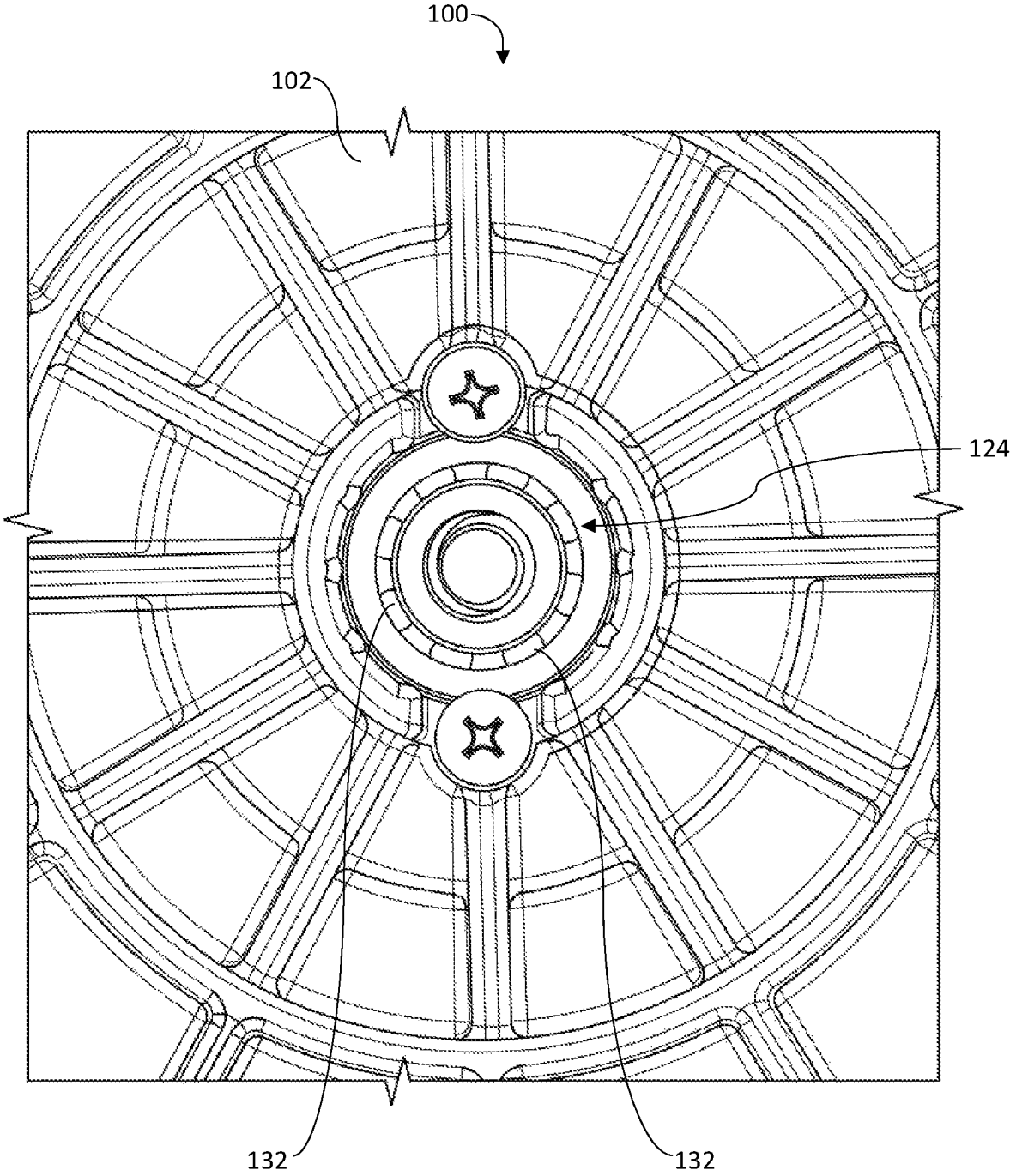
FIG. 12 is back detailed plan view of bearing components of a spinnable indicator.
Figure 13:
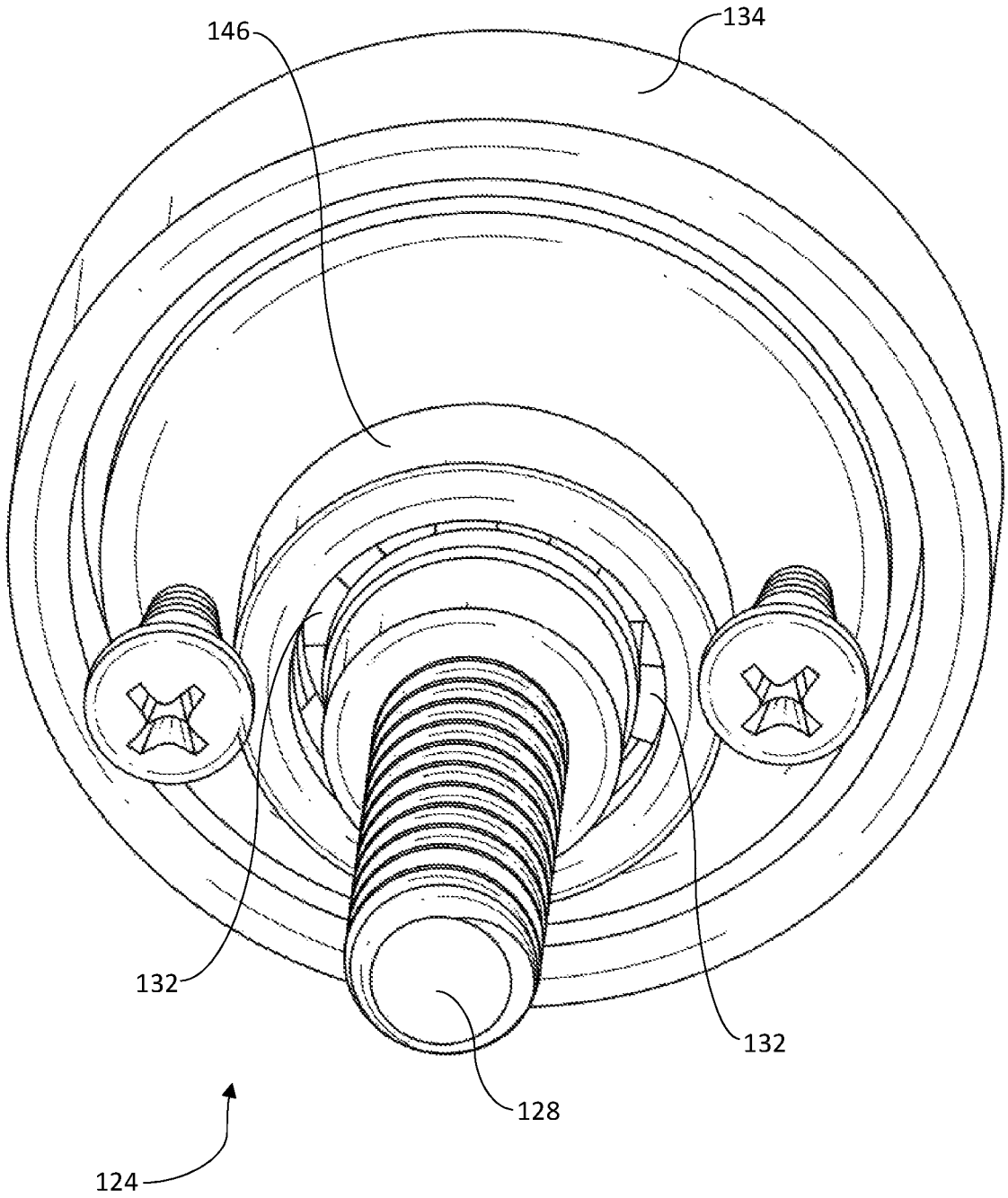
FIG. 13 is a back perspective view of bearing components of a spinnable indicator.

In one embodiment, referring to FIGS. 6 and 10-11, a weight 150 may be used to bias the disc 102 to a first, resting position when not in use. The first position allowing the text to remain upright and readable. The weight 150 may be coupled to the disc 102 in a variety of methods, such as using weight aperture 152 (FIG. 10) and an adhesive. However, other methods may likewise be used, such as thicker material at the bottom of the disc, threaded weights, or other method of ensuring a correct orientation (instructions readable) when not in use.

In one embodiment, a spinnable indicator may further comprise light-emitting diodes (LEDs) or other lights. The spinnable indicator may comprise LEDs alone, or may further comprise reflective surfaces in addition to the LEDs. One or more batteries may be located in a battery enclosure on the back side of the spinnable indicator, which may have keyed access to prevent theft and tampering. In one embodiment, the spinnable indicator comprises one or more solar panels for charging one or more batteries for supplying power to one or more LEDs.

In one method of use, a prospective passenger approaches a spinnable indicator 100, and, when a bus or other transit unit is approaching, spins the spinnable indicator 100. The reflective surface 110 on the front side 104 of the spinnable indicator 100 alerts the driver that a prospective passenger is awaiting transit. FIG. 16 illustrates the spinnable indicator 100 coupled to a bus sign 122, where it may be easily spun by all users. For example, in one embodiment, the spinnable indicator is mounted at about thirty-six inches from the ground, which is in line with ADA standards and allows kids to easily reach it as well. In one embodiment, a spacer may be used when coupling the spinnable indicator 100 to the pole, allowing for a frictionless spin with the pole and reducing the odds of a pinching injury. In one embodiment, the mounting bracket 108 may sized so as to be the spacer. For example, mounting bracket spacer 154 (FIG. 4) may be integral with mounting bracket 108.

In testing, the reflective material was highly visible at one block from the transit stop. Further, because the front side 104 of the disc 102 is not fully reflective (i.e., comprises a reflective portion 110 and non-reflective portion 111), a strobing effect is created when spinning, which allows a driver at night to easily identify when the spinnable indicator 100 is, in fact, spinning.

As appreciated from the foregoing, the spinning indicator described herein solves the need for a system and method of identifying transit stops for use by both prospective passengers and drivers, and that particularly allows a bus driver to quickly and easily determine when a prospective passenger is waiting.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A spinnable indicator for transit stops, comprising:

a disc having a front side and a back side, the front side comprising a reflective portion and a non-reflective portion;

a mounting bracket; and a rotational mechanism coupling the disc to the mounting bracket;

wherein the disc is spinnable on the rotational mechanism, and wherein the mounting bracket comprises a first arm having a securing aperture and a second arm having a securing aperture, each arm spaced so as to receive a pole or beam therebetween.

2. The spinnable indicator of claim 1, wherein the rotational mechanism comprises:

an inner member having a bolt aperture, a front plate, and a middle portion having a bearing groove; and an outer member having a bearing groove;

wherein the bearing groove of the middle portion and the bearing groove of the outer member align so as to receive ball bearings therebetween.

3. The spinnable indicator of claim 2, further comprising a cap.

4. The spinnable indicator of claim 1, wherein the disc further comprises a weight to bias the disc to a first position when not in use.

5. A method of using a spinnable indicator for transit stops to signal to a transit driver that a prospective passenger awaits, the method comprising:

coupling the spinnable indicator to a pole or beam at a transit stop, the spinnable indicator comprising a front side and a back side, the front side comprising a reflective portion and a non-reflective portion;

a prospective passenger spinning the spinnable indicator when the method of transit approaches, indicating to a driver the presence of a prospective passenger.

* * * * *